US011286153B1

(12) United States Patent
Kieras et al.

(10) Patent No.: US 11,286,153 B1
(45) **Date of Patent: *Mar. 29, 2022**

(54) DELAYED VENTING OF A DUAL RECEPTACLE, MULTIFUNCTION BUTTON SYSTEM

(71) Applicant: LB USA Flexibles, Inc., Bolingbrook, IL (US)

(72) Inventors: Ronald E. Kieras, Woodstock, IL (US); Loren L. Brelje, Glencoe, MN (US)

(73) Assignee: LB USA Flexibles, Inc., Bolingbrook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/365,700

(22) Filed: Jul. 1, 2021

(51) Int. Cl.
*B67D 3/04* (2006.01)

(52) U.S. Cl.
CPC ..... *B67D 3/046* (2013.01)

(58) Field of Classification Search
CPC ..... B67D 3/046; B67D 3/044; B65D 47/32
USPC ..... 222/518, 477, 559
See application file for complete search history.

(56) References Cited

U.S. PATENT DOCUMENTS

| | | | | |
|---|---|---|---|---|
| 422,935 | A | 3/1890 | Hamsley | |
| 730,530 | A | 6/1903 | Goold | |
| 1,054,705 | A | 3/1913 | Megirian | |
| 1,361,419 | A | 12/1920 | Tucker | |
| 1,494,043 | A * | 5/1924 | Vogt | H01M 50/60 222/484 |
| 1,525,032 | A | 2/1925 | Grady | |
| 1,990,226 | A | 2/1935 | Gottlob | |
| 2,141,870 | A | 12/1938 | Koukal | |
| 2,148,335 | A | 2/1939 | Arola | |
| 2,208,862 | A * | 7/1940 | Stringfellow | G01F 11/262 222/188 |
| 2,368,540 | A | 1/1945 | Goodman | |
| 2,519,479 | A * | 8/1950 | Kal | G01F 11/265 222/477 |
| 3,096,001 | A * | 7/1963 | Boe | B65D 83/68 222/135 |
| 3,635,380 | A * | 1/1972 | Fitzgerald | A45F 3/16 222/484 |
| 3,739,938 | A * | 6/1973 | Paz | A47G 19/2272 220/715 |
| 3,797,696 | A | 3/1974 | Dibrell | |

(Continued)

*Primary Examiner* — Paul R Durand
*Assistant Examiner* — Michael J. Melaragno
(74) *Attorney, Agent, or Firm* — McAndrews, Held & Malloy, Ltd.

(57) ABSTRACT

A dual port dispenser button system with an elastic receptacle button having a first latch receiver and a second latch receiver, and a dispenser with a dispensing valve and vent valve. The dispensing valve includes a valve seal member and first button latch. The vent valve includes an elastomer deflection part and flexible connector. The button has a first and second depressed position. In the first depressed position, the dispensing valve seal member moves from a first position where it seals the dispensing port to a second position where it does not seal the dispensing port while the deflection part remains in a first position where it seals a vent port. In the second depressed position, the valve seal member moves to a third position that does not seal the dispensing port and the deflection part moves to a second position where it does not seal the vent port.

9 Claims, 3 Drawing Sheets

(56) References Cited

U.S. PATENT DOCUMENTS

| | | | | |
|---|---|---|---|---|
| 6,401,752 | B1 | 6/2002 | Blackbourn | |
| 10,131,530 | B2 | 11/2018 | Trettin | |
| 10,981,705 | B2 | 4/2021 | Kieras | |
| 2002/0030063 | A1* | 3/2002 | Leray | B67D 3/043 222/129 |
| 2007/0007311 | A1 | 1/2007 | Uytterhaeghe | |
| 2010/0282345 | A1* | 11/2010 | Richards | B67D 3/044 137/588 |
| 2011/0017782 | A1* | 1/2011 | Nini | B67D 3/044 222/518 |
| 2012/0018459 | A1* | 1/2012 | Richards | B65D 47/249 222/484 |
| 2013/0341359 | A1 | 12/2013 | Vanier | |
| 2017/0247239 | A1* | 8/2017 | Nini | B67D 3/008 |
| 2019/0031490 | A1* | 1/2019 | Trettin | B67D 3/046 |
| 2020/0207527 | A1* | 7/2020 | Kieras | B65D 47/32 |
| 2020/0399112 | A1* | 12/2020 | Driskell | B65D 77/067 |

* cited by examiner

--Prior Art--

DELAYED VENTING OF A DUAL RECEPTACLE, MULTIFUNCTION BUTTON SYSTEM

BACKGROUND

Generally, taps with a flexible button and a single valve have been used to dispense fluids from containers. When existing taps are used with a rigid container, the container often requires a second opening elsewhere on the container to allow air to enter into the container to compensate for the decreased volume of fluid within the container, as the fluid is dispensed. The present disclosure relates to a tap with a twin receptacle button that moves a dispensing valve to dispense the fluid from the container and also opens a vent valve incorporated into the tap. The opening of the vent valve is delayed as compared to the opening of the dispensing valve.

SUMMARY

Certain embodiments of the present technology relate to a dual port dispenser button system. The system includes an elastic button, a tap dispenser, a first valve, and a second valve. The elastic button includes a first latch receiver and a second latch receiver. The tap dispenser includes a dispensing port and a vent opening. The first valve includes a valve seal member configured to seal the dispensing port and a first button latch that is secured to the first latch receiver. The second valve includes a deflection part configured to seal the vent opening and a flexible connector. The flexible connector includes a first end with a second button latch secured to the second latch receiver and a second end that is in contact with the deflection part. The button has a first depressed position and a second depressed position. In the first depressed position, the valve seal member is moved from a first position in which the first valve seal member seals the dispensing port to a second position in which the valve seal member does not seal the dispensing port such that fluid can flow out of the dispensing port, the flexible connector moves from a first position to a second position, and the deflection part remains in a first position in which the deflection part blocks the vent opening. In the second depressed position, the valve seal member is moved from the second position to a third position in which the valve seal member continues to not seal the dispensing port such that fluid can continue to flow out of the dispensing port, the flexible connector moves from a second position to a third position, and the deflection part is moved from the first position to a second position in which the deflection part does not block the vent opening.

The dispenser button system may elastically spring back to its original shape when it is no longer depressed which may cause the valve seal member to return to its first position and the deflection part to elastically spring back to its first position.

The deflection part may return to its first position before the valve seal member returns to its first position when the button is no longer depressed.

The deflection part may include a deflection portion cup. The second end of the flexible connector may include a vent end portion. The deflection portion cup may be configured to receive the vent end portion of the flexible connector.

The vent end portion of the flexible connector may slide within the deflection portion cup when the button moves from the undepressed position to the first depressed position.

The vent end portion may be thicker than other portions of the flexible connector.

The first button latch may snapably fit within the first latch receiver. The second button latch may snapably fit within the second latch receiver.

The button may be made of a thermoplastic elastomer.

The deflection part may be made of a thermoplastic elastomer.

DETAILED DESCRIPTION

Figure 1:
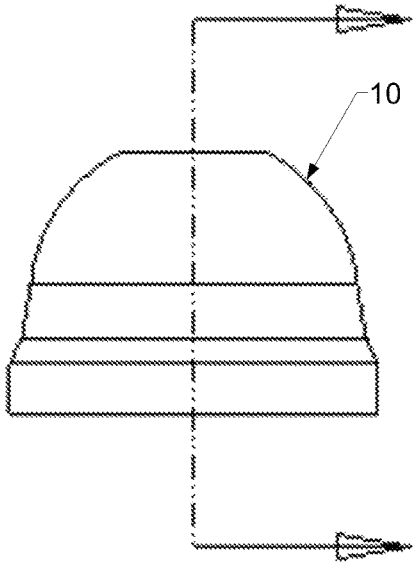
FIG. 1 shows the outside view of the receptacle button.

Referring to FIG. 1, a front outside view of a receptacle spring button 10 is shown. The spring button 10 is flexible and is made from, for example, a thermoplastic elastomer and is designed to elastically spring back to its undepressed position after being pressed and released.

Figure 2:
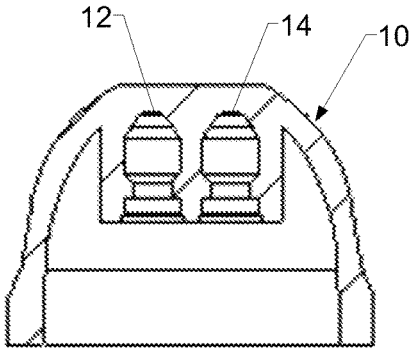
FIG. 2 shows the receptacle button, with parts cut away to show the inside.

Referring to FIG. 2, a view with parts cut away to show the inside of the button 10, shows the button 10 with the latch receivers 12 and 14 therein.

Figure 3:
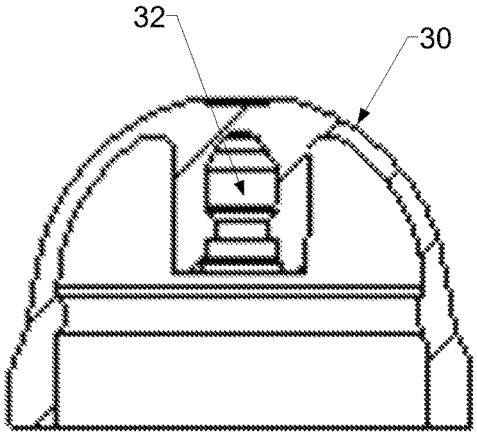
FIG. 3 shows a cross-sectional view of a conventional button with a single receptacle.

FIG. 3 shows a cross-sectional view of a conventional receptacle button 30 with a single receptacle 32.

Figure 4:
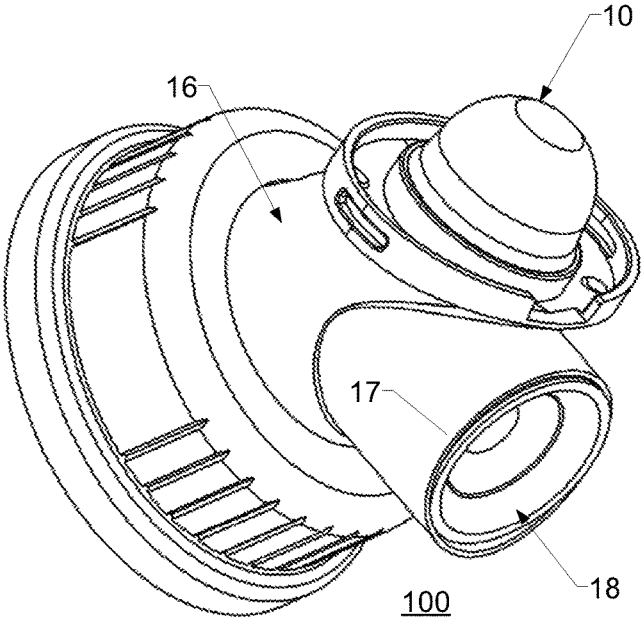
FIG. 4 shows the receptacle button installed on a tap forming a button system.

Referring to FIG. 4, the button 10 is shown on a tap 16 forming a twin receptacle button system 100. The button system 100 also includes a seal member 18, which seals the tap opening at the inner wall of the tap dispenser 17 when the button 10 is in the undepressed position, which is the position shown in FIG. 4.

Figure 6:
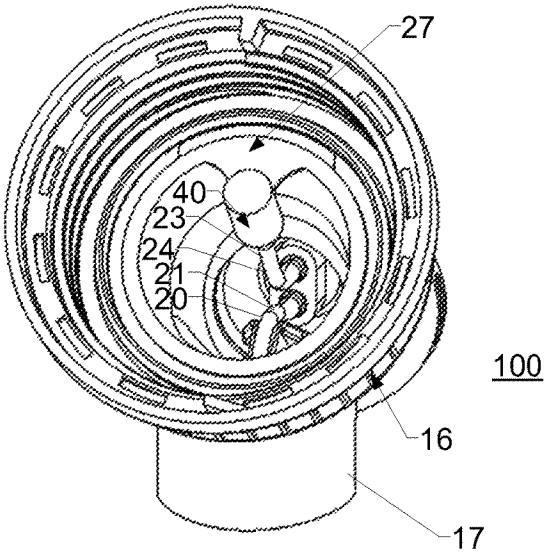
FIG. 6 shows a rear isometric view of the button system of FIG. 4.
Figure 5:
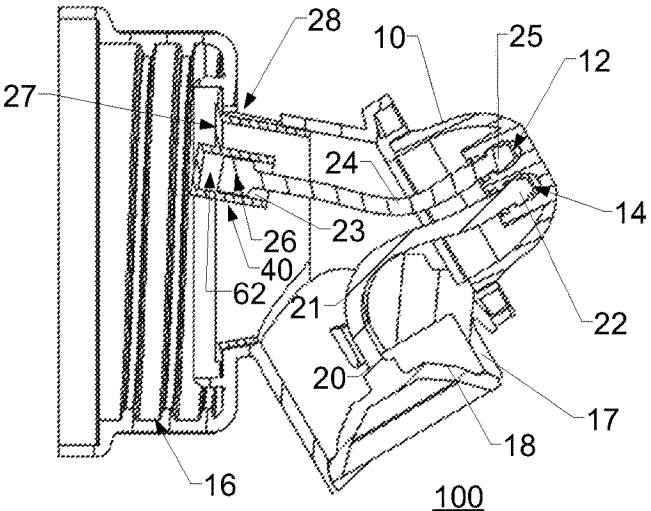
FIG. 5 shows a cross-sectional side view of the button system shown in FIG. 4, with the button in an undepressed position.

Referring now to FIGS. 5 and 6, the button system 100 is shown. The button system 100 includes a first valve 20 which has a flexible stem 21 and seal member 18. The seal member 18 is designed and sized to frictionally seal to an inner wall of the tap dispenser 17. The first valve further includes a first button latch 22 which snapably fits into the button latch receiver 14 to connect the valve 20 to the elastic spring button 10. The button system 100 also includes a second valve 23 which includes a flexible connector 24 and a thermal plastic elastomer deflection part 27. The flexible connector 24 has a second button latch 25, which snapably fits into the second button latch receiver 12 to connect the flexible connector 24 to the elastic spring button 10. The flexible connector 24 terminates in a vent end 26, which fits into a cup 40 of the thermal plastic elastomer deflection part 27.

Figure 7:
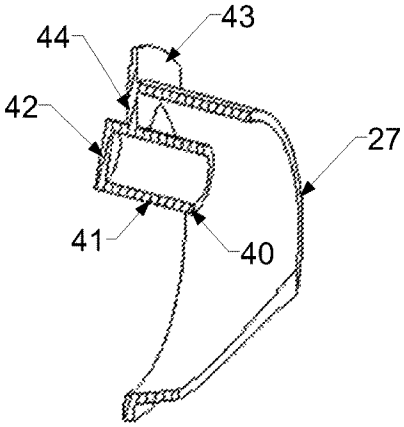
FIG. 7 shows a cross-sectional view of the deflection part shown in FIG. 5.

FIG. 7 shows a cross-sectional view of a deflection part 27. The deflection part 27 includes the cup 40, which has a sidewall 41 and a base wall 42. The deflection part 27 also has a sealing portion 43. A connection wall 44 connects the cup 40 and the sealing portion 43 of the deflection part 27.

Figure 8:
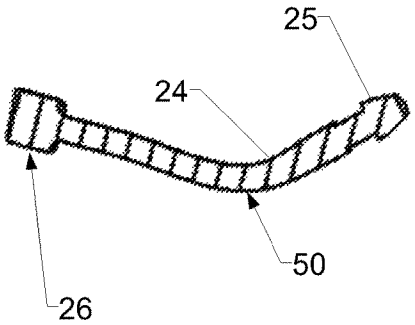
FIG. 8 shows a cross-sectional view of the flexible connector shown in FIG. 5.

FIG. 8 shows a cross-sectional view of the flexible connector 24 of FIG. 5. The flexible connector 24 has a flexible portion 50 that connects the vent end 26 with the second button latch 25. The vent end 26 is wider than the flexible portion 50 and the second button latch 25.

Figure 9:
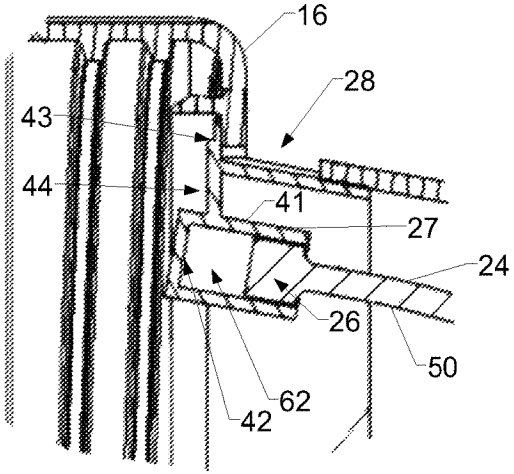
FIG. 9 shows an enlarged view of the tap, deflection part, and second connector shown in FIG. 5 with the button in the undepressed position.

FIG. 9 shows an enlarged view of the tap 16, deflection part 27, and flexible connector 24 to correspond with the button 10 in the undepressed position shown in FIG. 5. In the undepressed position, the button 10 holds the seal member 18 within the inner wall of the dispenser 17, preventing the flow of fluid from the dispenser 17 of the tap 16. Also in the undepressed position, the flexible connector flexible portion 50 holds the vent end 26 within the sidewall 41 of the deflection part cup 40. The vent end 26 slidingly fits within the sidewall 41, and a gap 62 exists between the vent end 26 and the cup base wall 42 such that the cup 41, the connection wall 44, and the sealing portion 43 remain undeflected, and the sealing portion 43 seals the tap vent opening 28.

Figure 10:
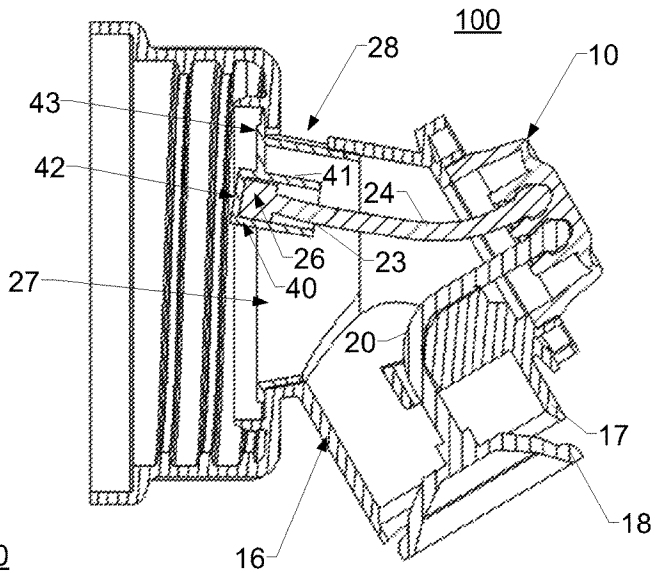
FIG. 10 shows the button system of FIG. 5 with the button in a partially depressed position.

FIG. 10 shows the button system 100 of FIG. 5 with the button 10 in a partially depressed position. The button 10 can be depressed by a user applying downward pressure on the button 10. The button 10 forces the seal member 18 of first valve 20 downward a first distance such that the seal between the seal member 18 and the tap dispenser 17 is broken, allowing fluid to flow from a connected container and out of the tap 16. In the partially depressed position, the vent end 26 has just made contact with the cup base wall 42. The sliding fit between the vent end 26 and the cup sidewall 41 allows the vent end 26 to move from the position shown in FIG. 9 to the position in FIG. 10 without moving the deflection part 27, and allowing the sealing portion 43 to remain in contact with, and seal, the tap vent opening 28.

Figure 11:
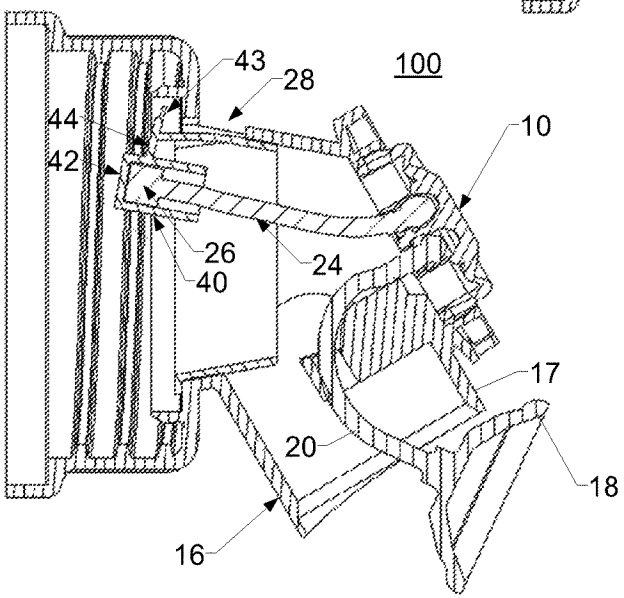
FIG. 11 shows the button system of FIG. 5 with the button in a fully depressed position.

FIG. 11 shows the button system 100 of FIG. 5 with the button 10 in a fully depressed position. The button 10 forces the seal member 18 of first valve 20 further downward to a second distance from the tap dispenser 17, allowing increased fluid flow from the connected container and out the tap dispenser 17. The vent end 26 of the flexible connector 24 presses against the cup base wall 42, and forces the cup base wall 42 to the left, or toward the container to which the tap 16 is connected and away from the button 10. The cup 40 in turn forces the connection wall 44 to the left which in turn forces the sealing portion 43 to the left, breaking the seal between the deflection part 27 and the vent opening 28 of the tap 16. Due to the establishment of fluid flow out of the tap dispenser 17 when the button 10 is in the partially depressed position of FIG. 10, and prior to breaking the seal at the vent opening 28, a slight vacuum is created within the container by the decreased volume of fluid within the container. By opening the vent opening 28, a flow path is provided for air to enter the container to compensate for the fluid loss without interrupting the flow of fluid from the tap dispenser 17 while also minimizing the ability of fluid to exit the vent opening 28 instead of the opening at the tap dispenser 17.

Once the button 10 is released, the button passes through the partially depressed position of FIG. 10 allowing the deflection part 27 to return to the sealed position as the vent end 26 no longer pushes on the cup base wall 42 while the seal member 18 is still partially extended from the tap dispenser 17. Once the button 10 reaches the undepressed position, the button 10 pulls the seal member 18 back to the sealed position of FIG. 5, thereby stopping flow out of the tap dispenser 17.

Although as shown in FIGS. 9-11 as discrete positions, the button 10 can move through a full range of positions between these shown positions. Additionally, the size of the gap 62 between the vent end 26 and the cup base wall 42 can be adjusted by modifying various dimensions of the flexible connector 24 and/or the deflection part 27. By increasing the size of the gap 62, the venting of the tap 16 is further delayed, assuming a similar speed of the button being depressed. Increasing the size of the gap 62 would also decrease the movement of the deflection part sealing portion 43, thus restricting the flow through the vent opening 28. The airflow through the vent opening 28 may also be optimized based on the expected flow out of the tap dispenser 17 and/or other factors such as viscosity of the fluid within the container and the container size. Adjustments to the size of the vent opening 28 may further prevent fluid from exiting the vent opening 28.

In the embodiment described, button 10 is shown with a circular base. However, other shapes and configurations are also contemplated, for example, the base can also be square, rectangular, hexagonal, octagonal, or in the shape of any other suitable polygon. In some embodiments, the cross-section of material can be thicker at the base of the button 10 than nearer its peak. It should also be understood that valve seal member, which is shown as being circular, could also be other shapes, such as oval, square, rectangular, hexagonal, octagonal or any other desired shape, designed to matingly seal to a compatible shape of a dispenser port.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be passed by the claims.

Those skilled in the art may recognize other equivalents to the specific embodiment described herein which equivalents are intended to be encompassed by the claims attached hereto.

The invention claimed is:

1. A dual port dispenser button system, comprising:

an elastic button including a first latch receiver and a second latch receiver;

a tap dispenser with a dispensing port and a vent opening;

a first valve including a valve seal member and a first button latch, wherein the valve seal member is configured to seal the dispensing port and the first button latch is secured to the first latch receiver;

a second valve including a deflection part and a flexible connector, the flexible connector:

having a first end with a second button latch secured to the button second latch receiver; and having a second end in contact with the deflection part, wherein the deflection part is configured to seal the vent opening;

wherein the button is configured to be depressed from an undepressed position to a first depressed position and a second depressed position and, when the button is depressed to the first depressed position, (i) the valve seal member is moved from a first position in which the first valve seal member seals the dispensing port to a second position in which the valve seal member does not seal the dispensing port such that fluid can flow out of the dispensing port, (ii) the flexible connector moves from a first position to a second position, and (iii) the deflection part remains in a first position in which the deflection part blocks the vent opening; and when the button is further depressed to the second depressed position (i) the valve seal member is moved from the second position to a third position in which the valve seal member continues to not seal the dispensing port such that fluid can continue to flow out of the dispensing port, (ii) the flexible connector moves from a second position to a third position, and (iii) the deflection part is moved from the first position to a second position in which the deflection part does not block the vent opening.

2. The dual port dispenser button system of claim 1, wherein when the button is no longer depressed, it elastically springs back to its original shape, which causes the valve seal member to return to its first position and the deflection part to elastically spring back to its first position.

3. The dual port dispenser button system of claim 2, wherein when the button is no longer depressed, the deflection part returns to its first position before the valve seal member to returns to its first position.

4. The dual port dispenser button system of claim 1, wherein:

the deflection part further comprises a deflection portion cup;

the second end of the flexible connector further comprises a vent end portion; and the deflection portion cup is configured to receive the vent end portion of the flexible connector.

5. The dual port dispenser button system of claim 4, wherein the vent end portion of the flexible connector slides within the deflection portion cup when the button moves from the undepressed position to the first depressed position.

6. The dual port dispenser button system of claim 5, wherein the vent end portion of the flexible connector is thicker than the other portions of the flexible connector.

7. The dual port dispenser button system of claim 1, wherein the first button latch snapably fits into the first latch receiver and the second button latch snapably fits into the second latch receiver.

8. The dual port dispenser button system of claim 1, wherein the button is made of thermoplastic elastomer.

9. The dual port dispenser button system of claim 1, wherein the deflection part is made of thermoplastic elastomer.

* * * * *